US010462547B2

(12) United States Patent
Kawata et al.

(10) Patent No.: US 10,462,547 B2
(45) Date of Patent: Oct. 29, 2019

(54) SOUND TRANSMISSION DEVICE AND SOUND TRANSMISSION SYSTEM

(71) Applicant: Murata Manufacturing Co., Ltd., Nagaokakyo-shi, Kyoto-fu (JP)

(72) Inventors: Shuichi Kawata, Nagaokakyo (JP); Yoshihiro Iwasaki, Nagaokakyo (JP); Shinsuke Shichi, Nagaokakyo (JP); Yasutada Tanimoto, Nagaokakyo (JP); Kazuya Nakatera, Nagaokakyo (JP); Yoshiaki Katagiri, Nagaokakyo (JP)

(73) Assignee: MURATA MANUFACTURING CO., LTD., Nagaokakyo-Shi, Kyoto-Fu (JP)

( * ) Notice: Subject to any disclaimer, the term of this patent is extended or adjusted under 35 U.S.C. 154(b) by 0 days.

(21) Appl. No.: 15/907,564

(22) Filed: Feb. 28, 2018

(65) Prior Publication Data

US 2018/0192178 A1 Jul. 5, 2018

Related U.S. Application Data

(63) Continuation of application No. PCT/JP2016/072481, filed on Aug. 1, 2016.

(30) Foreign Application Priority Data

Sep. 3, 2015 (JP) ..... 2015-173716

(51) Int. Cl.
*H04R 17/00* (2006.01)
*H04R 1/10* (2006.01)
*H04R 1/06* (2006.01)

(52) U.S. Cl.
CPC ..... *H04R 1/1008* (2013.01); *H04R 1/1075* (2013.01); *H04R 1/06* (2013.01);
(Continued)

(58) Field of Classification Search
CPC ..... H04R 1/00; H04R 1/06; H04R 1/1008; H04R 17/00; H04R 2460/13
(Continued)

(56) References Cited

U.S. PATENT DOCUMENTS

2004/0183690 A1* 9/2004 Nakagawa ..... H04R 25/606 340/4.11
2017/0111728 A1* 4/2017 Kim ..... H04R 1/1075

FOREIGN PATENT DOCUMENTS

JP 61238196 A * 10/1986 ..... H04R 19/013
JP S61-238196 A 10/1986
JP 2007-104548 A 4/2007

OTHER PUBLICATIONS

International Search Report issued for PCT/JP2016/072481, dated Oct. 11, 2016.

(Continued)

*Primary Examiner* — Melur Ramakrishnaiah
(74) *Attorney, Agent, or Firm* — Arent Fox LLP

(57) ABSTRACT

A sound transmission system that includes a sound transmission device that is brought into contact with a human body and a sound signal generation device connected to the sound transmission device. The sound transmission device includes an insulator that is brought into contact with the human body, a conductor that is in contact with the insulator, and an input that is provided on the conductor and inputs a driving voltage. One end of the sound signal generation device is connected to the input, and the sound signal generation device supplies the driving voltage based on a sound signal to the sound transmission device.

19 Claims, 10 Drawing Sheets

(52) U.S. Cl.
CPC ..... *H04R 1/1033* (2013.01); *H04R 1/1041* (2013.01); *H04R 17/00* (2013.01); *H04R 2460/13* (2013.01)

(58) Field of Classification Search
USPC ..... 381/151, 380
See application file for complete search history.

(56) References Cited

OTHER PUBLICATIONS

Written Opinion of the International Searching Authority issued for PCT/JP2016/072481, dated Oct. 11, 2016.

* cited by examiner

SOUND TRANSMISSION DEVICE AND SOUND TRANSMISSION SYSTEM

CROSS REFERENCE TO RELATED APPLICATIONS

The present application is a continuation of PCT/JP2016/072481 filed Aug. 1, 2016, which claims priority to Japanese Patent Application No. 2015-173716, filed Sep. 3, 2015, the entire contents of each of which are incorporated herein by reference.

TECHNICAL FIELD

The present disclosure relates to a sound transmission device and a sound transmission system, and, more particularly, to a sound transmission device that is worn on a human body to make it possible to listen to a sound, and a sound transmission system.

BACKGROUND ART

Conventionally, a headphone, an earphone (wearable speaker), and the like are known as devices that can be worn on a human body to listen to sound. However, a headphone is used to listen to a sound by pressing and wearing sounding bodies (speakers) so as to cover both ears, whereas an earphone is worn by inserting a sounding body into an ear canal to listen to a sound. Therefore, a sound emitted other than from the headphone during the use of the headphone or earphone is difficult to listen to in some cases, which may lead to danger or inconvenience depending on the use situation. Also, a headphone and an earphone are not designed to accommodate the use for simultaneously listening to a sound from the headphone or earphone and a sound emitted from other than the headphone or the like.

Among devices that are worn on a human body to listen to a sound, a bone conduction speaker is known as a device that avoids blocking the ear. Patent Document 1 (identified below) discloses a bone conduction speaker that directly transmits voice information to an inner ear through air by pressing a vibrator against a skin on bone tissue such as near an auricle and mandibular bone through the bone tissue without passing through a middle ear transmission system. With this bone conduction speaker, it is possible to simultaneously listen to a sound from the speaker and a sound emitted other than from the speaker without blocking the ear.

Patent Document 1: Japanese Patent Application Laid-Open No. 2007-104548.

However, the bone conduction speaker disclosed in Patent Document 1 transmit a sound by vibrating a vibrator when a sound signal is input and pressing and wearing the vibrator on the skin on the bone tissue. Therefore, the bone conduction speaker is configured to vibrate the vibrator when a sound signal is input, regardless of whether the vibrator is pressed and worn on the skin on the bone tissue. Even while not listening to a sound, electric power is consumed. Likewise, a conventional headphone and earphone consume electric power even while not listening to a sound because a sounding body generates a sound when a sound signal is input, regardless of whether the headphone or earphone is worn on the ear.

SUMMARY OF THE INVENTION

Therefore, an object of the present disclosure is to provide a sound transmission device and a sound transmission system that operates only when worn, making it possible to simultaneously listen to a sound transmitted from the device and a sound emitted other than from the device, without blocking the ear.

Therefore, a sound transmission device is disclosed that includes an insulator including a first portion that is brought into contact with a human body; a conductor that is in contact with a second portion of the insulator different from the first portion; and an input that is provided in the conductor and configured to input a driving voltage based on a sound signal.

Moreover, a sound transmission system is disclosed that includes a sound transmission device that is brought into contact with a human body; and a sound signal generation device that is connected to the sound transmission device. in this aspect, the sound transmission device includes an insulator including a first portion that is brought into contact with the human body; a conductor that is in contact with a second portion of the insulator different from the first portion; and an input that is provided in the conductor and configured to input a driving voltage. One end of the sound signal generation device is connected to the input, and the sound signal generation device supplies the driving voltage based on a sound signal to the sound transmission device.

According to exemplary embodiments of the present disclosure, the sound transmission device can be worn on the human body without blocking the ear, and thus it is possible to simultaneously listen to a sound transmitted from the device and a sound emitted other than from the device. Also, according to the exemplary embodiments, since the sound transmission device operates only when worn on the human body, it is possible to reduce power consumption when not listening to a sound.

DETAILED DESCRIPTION

A sound transmission device and a sound transmission system according to exemplary embodiments will be described below.

First Embodiment

Figure 1:
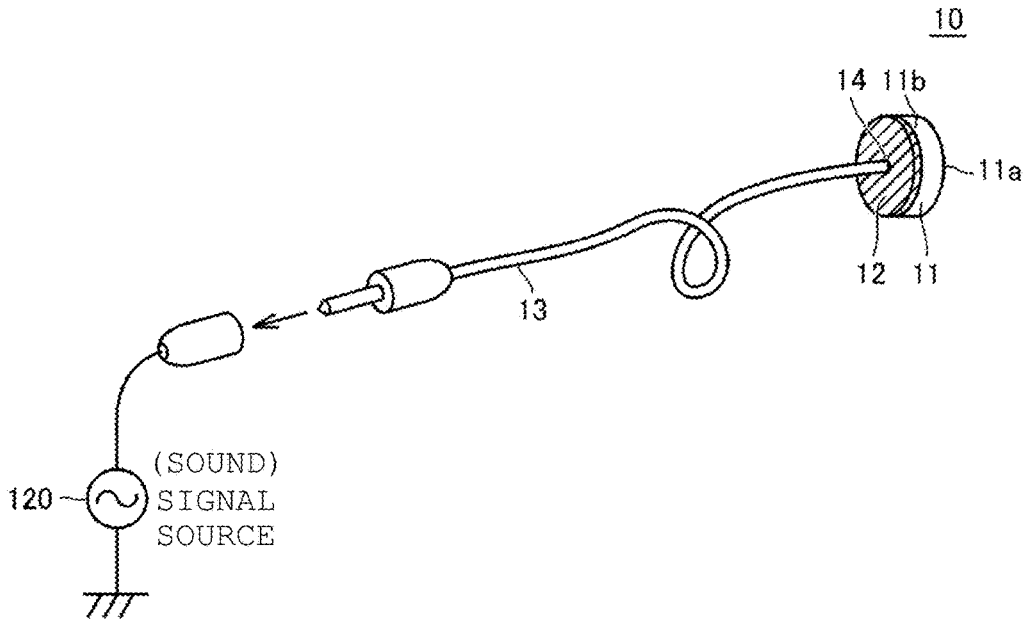
FIG. 1 is a schematic diagram of a sound transmission device according to a first exemplary embodiment.
Figure 2:
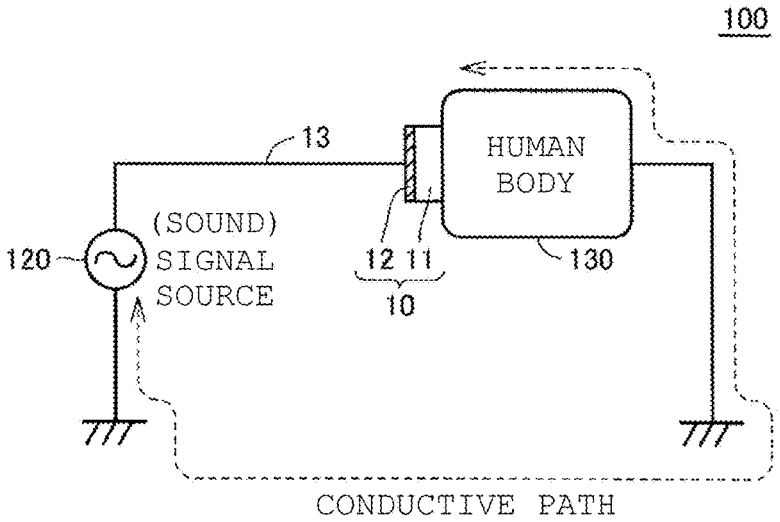
FIG. 2 is a schematic diagram of a sound transmission system according to the first exemplary embodiment.

A sound transmission device and a sound transmission system according to a first exemplary embodiment will be described below with reference to the drawings. FIG. 1 is a schematic diagram of the sound transmission device according to the first exemplary embodiment. FIG. 2 is a schematic diagram of the sound transmission system according to the first exemplary embodiment.

As illustrated in FIG. 1, the sound transmission device 10 includes an insulator 11, a conductor 12 laminated on the insulator 11, and a wire 13 connected to the conductor 12 with solder. The insulator 11 is formed of a polyimide film, and a surface (first portion 11*a*) opposite to a surface in contact with the conductor 12 (second portion 11*b*) is brought into contact with a human body. The conductor 12 is formed of a copper plate. The wire 13 is formed of a one-core copper wire, and one end thereof is connected to the conductor 12 with solder, for example. Here, a portion where the one end of the wire 13 is connected to the conductor 12 with solder is an input portion 14 (i.e., an "input", the terms are used interchangeably) for inputting a driving voltage based on a sound signal into the sound transmission device 10. That is, the input portion 14 is an electric connection portion between a sound signal generation device 120 for inputting the driving voltage based on the sound signal and the sound transmission device 10. In the sound transmission device 10 illustrated in FIG. 1, the one end of the wire 13 is directly connected to the conductor 12 with solder. However, for example, a terminal for connecting the wire 13 to the conductor 12 may be provided. In this case, the terminal corresponds to the input portion 14 provided in the conductor 12.

The other end of the wire 13 is connected to the sound signal generation device 120 that is a sound signal source with a connection plug interposed therebetween. It is noted that the other end of the wire 13 may be directly connected to the sound signal generation device 120 without providing the connection plug. One end of the sound signal generation device 120 is connected to the wire 13, whereas the other end is grounded. The sound signal generation device 120 inputs the driving voltage based on the sound signal to the conductor 12 through the wire 13.

Even if the driving voltage based on the sound signal from the sound signal generation device 120 is input into the input portion 14, the sound transmission device 10 does not transmit a sound unless the insulator 11 is in contact with a human body 130. As illustrated in FIG. 2, by bringing the insulator 11 of the sound transmission device 10 into contact with the human body 130, it is possible to form a conductive path illustrated by a broken line and to form a sound transmission system that transmits a sound to the human body 130. The conductive path illustrated in FIG. 2 is formed by grounding and electrically connecting the other end of the sound signal generation device 120 and the human body 130 that is in contact with the sound transmission device 10. Here, in addition to a method of positively grounding the human body 130, such as by touching a ground electrode, using an instrument or the like for bringing a metal such as an earth band into direct contact with the skin, a method of grounding the human body 130 also includes a method of grounding the human body 130 with worn clothes and shoes interposed therebetween. It is noted that in order to listen to a sound clearly with the sound transmission device 10, a method of positively grounding the human body 130 by using an earth band or the like is more preferable in an exemplary aspect.

Figure 3A:
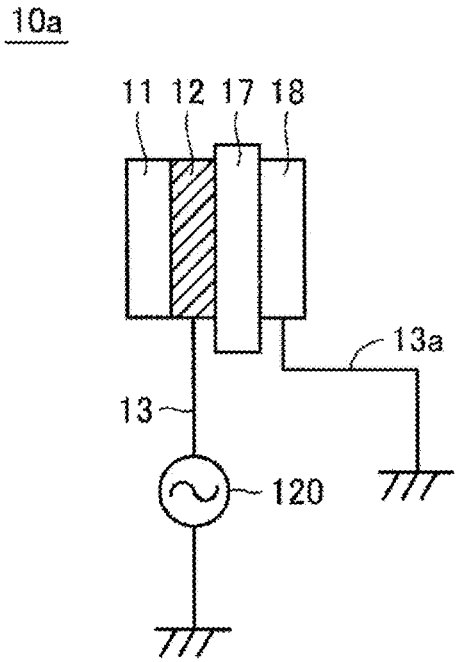
FIGS. 3(*a*) and 3(*b*) are schematic diagrams illustrating one example of the sound transmission device according to the first exemplary embodiment.
Figure 3B:
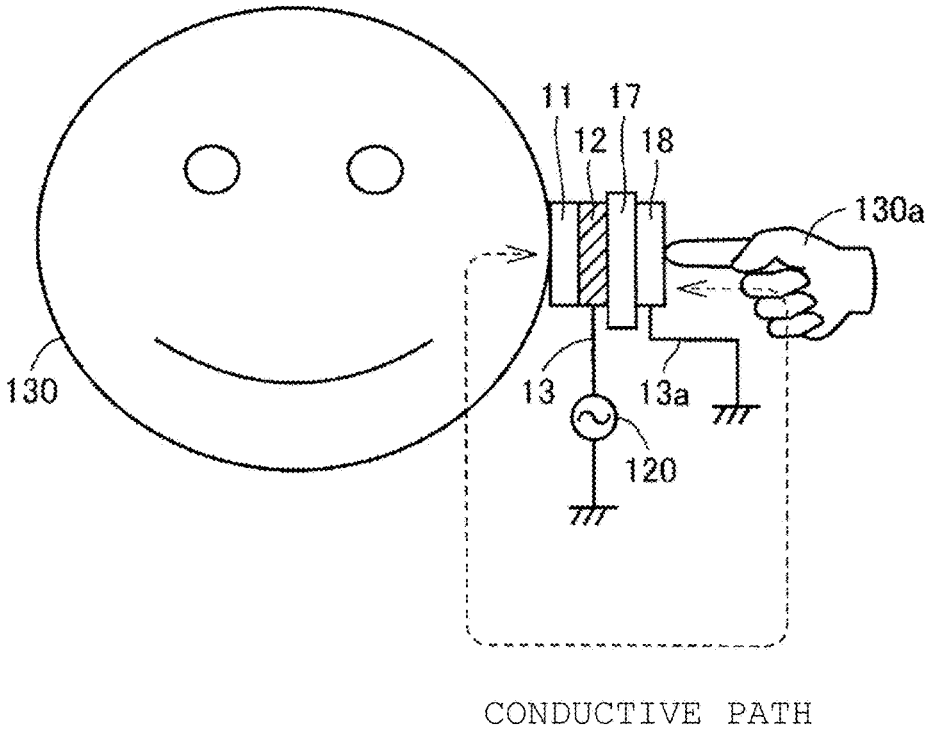

More specifically, the sound transmission device that considers grounding the human body 130 will be described. FIG. 3 is a schematic diagram illustrating one example of the sound transmission device according to the first exemplary embodiment. As illustrated in FIG. 3(*a*), the sound transmission device 10*a* includes an insulator 11, a conductor 12 laminated on the insulator 11, a grounding insulator 17 laminated on the conductor 12, and a grounding conductor 18 laminated on the grounding insulator 17. It is noted that in the sound transmission device 10*a*, a component identical to a component of the sound transmission device 10 illustrated in FIG. 1 is denoted with an identical symbol, and a detailed description thereof will be omitted. The grounding insulator 17 is larger than the conductor 12 in diameter and is formed of the same polyimide film as in the insulator 11. Of course, it should be appreciated the grounding insulator 17 may be formed of an insulating material different from an insulating material of the insulator 11. The grounding conductor 18 is formed of the same copper plate as in the conductor 12. Moreover, the grounding conductor 18 may be formed of a conducting material different from a conducting material of the conductor 12 as should be appreciated to one skilled in the art.

The conductor 12 is connected to the sound signal generation device 120 with the wire 13 interposed therebetween, and the grounding conductor 18 is grounded with the wire 13*a* interposed therebetween. As illustrated in FIG. 3(*b*), a surface of the insulator 11 opposite to a surface that is in contact with the conductor 12 is brought into contact with the human body 130. Furthermore, a surface of the grounding conductor 18 opposite to a surface that is in contact with the grounding insulator 17 is brought into contact with a hand 130*a* of the human body, for example. That is, by holding a grounding conductor 18 side of the sound transmission device 10*a* with the hand 130*a* and pressing an insulator 11 side against the human body 130 (for example, on the skin around the ear), a conductive path illustrated by a broken line is formed. The conductive path illustrated in FIG. 3(*b*) is formed by electrically connecting the insulator 11 to the grounding conductor 18 with the human body 130 interposed therebetween, implementing a grounded state. With this configuration, the sound transmission system that transmits a sound to the human body 130 by using the sound transmission device 10*a* can be formed. It is noted that since the grounding insulator 17 is larger than the conductor 12 in diameter in this configuration, the grounding conductor 18 will not be short-circuited to the conductor 12 according to the exemplary aspect.

Figure 4A:
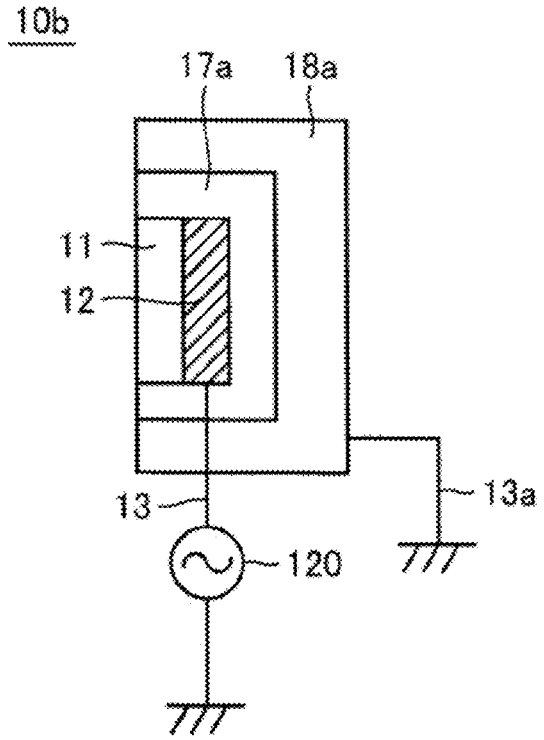
FIGS. 4(*a*) and 4(*b*) are schematic diagrams illustrating another example of the sound transmission device according to the first exemplary embodiment.
Figure 4B:
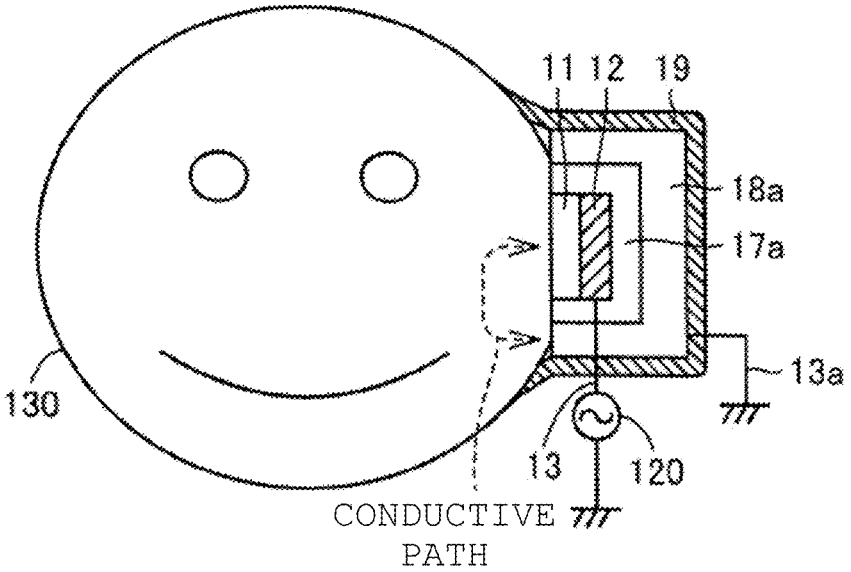

FIG. 4 is a schematic diagram illustrating another example of the sound transmission device according to the first exemplary embodiment. As illustrated in FIG. 4(*a*), the sound transmission device 10*b* includes an insulator 11, a conductor 12 laminated on the insulator 11, a grounding insulator 17*a* laminated on the conductor 12, and a grounding conductor 18*a* covering the grounding insulator 17*a*. It is noted that in the sound transmission device 10*b*, a component identical to a component of the sound transmission device 10 illustrated in FIG. 1 and the sound transmission device 10*a* illustrated in FIG. 3 is denoted with an identical symbol, and a detailed description thereof will be omitted. The grounding insulator 17*a* is larger than the conductor 12 in diameter and has a shape covering not only the conductor 12 but also a side surface of the insulator 11. It is noted that the grounding insulator 17*a* may be formed of the same polyimide film as in the insulator 11, or may be formed of an insulating material different from the insulating material of the insulator 11. Since the grounding conductor 18*a* covers the grounding insulator 17*a*, the grounding conductor 18*a* is formed such that an end surface of the grounding conductor 18*a* is flush with a surface of the insulator 11 and an end surface of the grounding insulator 17*a*. It is noted that the grounding conductor 18*a* may be formed of the same copper plate as in the conductor 12, or may be formed of a conducting material different from the conducting material of the conductor 12.

The conductor 12 is connected to the sound signal generation device 120 with a wire 13 interposed therebetween, and the grounding conductor 18*a* is grounded with a wire 13*a* interposed therebetween. As illustrated in FIG. 4(*b*), when a surface of the insulator 11 opposite to a surface that is in contact with the conductor 12 is brought into contact with the human body 130, the flush end surface(s) of the grounding conductor 18*a* will also be in contact with the human body 130. In other words, by pressing an insulator 11 side of the sound transmission device 10*b* against the human body 130 (for example, on the skin around the ear), a conductive path illustrated by a broken line is formed. The conductive path illustrated in FIG. 4(*b*) is formed by electrically connecting the insulator 11 to the grounding conductor 18*a* with the human body 130 interposed therebetween, implementing a grounded state. With this configuration, the sound transmission system can be formed that transmits a sound to the human body 130 using the sound transmission device 10*b*.

Figure 10A:
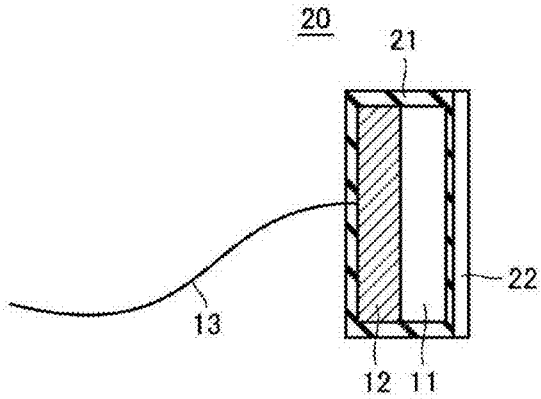
FIG. 10(*a*) is a cross-sectional view of a sound transmission device according to a second exemplary embodiment and FIG. 10 (*b*) is a conceptual diagram when the sound transmission device is worn.
Figure 10B:
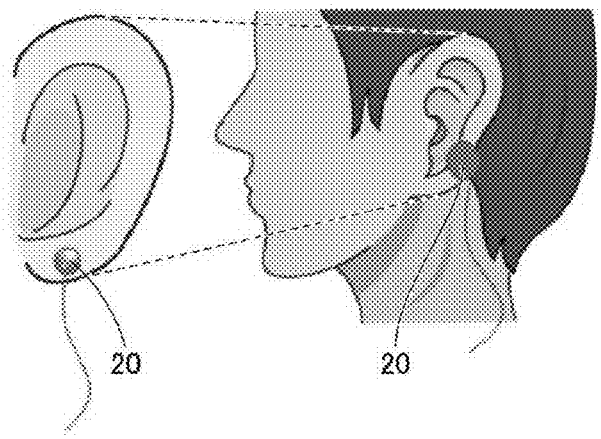

In the sound transmission device 10*a* illustrated in FIG. 3(*b*), the conductive path cannot be maintained unless the sound transmission device 10*a* is continuously held by the hand 130*a* of the human body. Alternatively, in the sound transmission device 10*b* illustrated in FIG. 4(*b*), the conductive path can be maintained by sticking the sound transmission device 10*b* on the human body 130 with an adhesive sheet 19. That is, with the insulator 11 and the grounding conductor 18*a* of the sound transmission device 10*b* being in contact with the human body 130, the sound transmission device 10*b* is stuck on the human body 130 with the adhesive sheet 19. Consequently, the conductive path is formed between the insulator 11 and the grounding conductor 18*a*, and the conductive path can be maintained without continuously holding the sound transmission device 10*b* with the hand of the human body. Of course, instead of the adhesive sheet 19, an adhesive tape may be used. It is noted that in addition to sticking the sound transmission device 10*b* on the human body 130 so as to cover the sound transmission device 10*b* with the adhesive sheet 19, any method may be used as long as this method makes it possible to maintain a state in which the insulator 11 and the grounding conductor 18*a* are in contact with the human body 130. For example, the sound transmission device 10*b* may have a holder that holds an earlobe with the insulator 11 and the grounding conductor 18*a* being in contact with the earlobe. Furthermore, for example, by adding an adhesive layer 22 as illustrated in FIG. 10, for example, to a surface on the insulator 11 side of the sound transmission device 10*b*, the sound transmission device 10*b* may be stuck on the skin around the ear of the human body 130. However, when the adhesive layer 22 is a conductive material, it is necessary to consider preventing the insulator 11 and the grounding conductor 18*a* from directly conducting, with the adhesive layer 22 interposed therebetween. Meanwhile, when the adhesive layer 22 is an insulator, it is necessary to consider reducing the thickness thereof so as not to interfere with conduction between the insulator 11 and the grounding conductor 18*a*, and the human body 130.

The sound transmission system 100 can transmit a sound to the human body 130 and make it possible to listen to the sound by bringing the sound transmission device 10 into contact with the skin around the ear of the human body 130 (for example, tragus) and inputting the driving voltage based on the sound signal from the sound signal generation device 120 into the conductor 12. It is noted that the driving voltage necessary for listening to a sound in an audible range with the sound transmission system 100 is about 700 Vp-p. Here, Vp-p represents a potential difference between peaks of the driving voltage fluctuating based on the sound signal. An area with which the sound transmission device 10 is brought into contact includes the skin around the ear (around an outer ear) such as a helix, earlobe, and temple. When the sound transmission device 10 is brought into contact with the skin in this area, the sound transmission system 100 makes it possible to listen to a sound from the sound transmission device 10.

When the sound transmission device 10 is separated from the human body 130, the conductive path illustrated in FIG. 2 is cut. As a result, the sound cannot be transmitted from the sound transmission device 10 to the human body 130 anymore. Therefore, the sound transmission system 100 is prevented from generating the sound. That is, since the sound transmission system 100 operates only when the sound transmission device 10 is in contact with the human body 130, power consumption can be advantageously reduced without consuming electric power while the sound transmission device 10 is not worn.

Figure 5A:
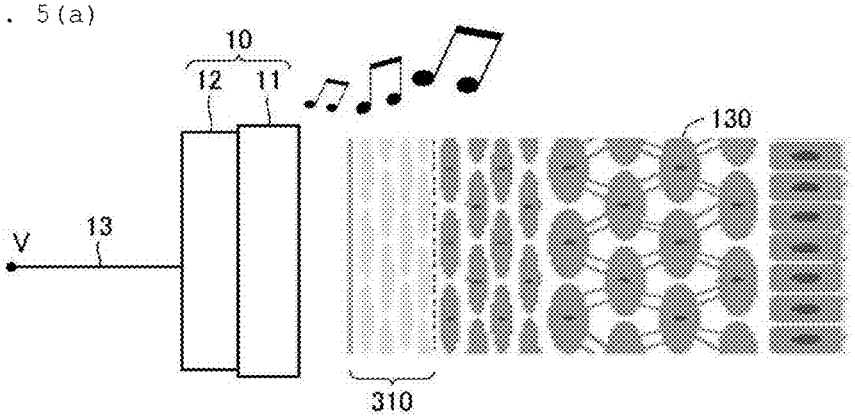
FIGS. 5(*a*) and 5(*b*) are a conceptual diagram and an equivalent circuit diagram of the sound transmission device using a dielectric according to the first exemplary embodiment.
Figure 5B:
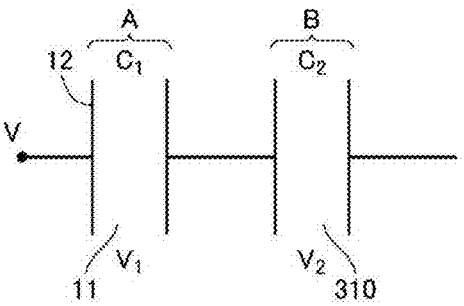

Next, the principle of transmitting a sound to the human body 130 by bringing the sound transmission device 10 into contact with the human body 130 will be described. FIG. 5 is a conceptual diagram and an equivalent circuit diagram of the sound transmission device using a dielectric according to the first exemplary embodiment. As illustrated in FIG. 5(*a*), the insulator 11 of the sound transmission device 10 is in contact with a stratum corneum 310 of the skin of the human body 130. The stratum corneum 310 can be regarded as an insulating layer having a thickness of 10 μm to 20 μm. Therefore, when the sound transmission device 10 is brought into contact with the human body 130, as in the equivalent circuit illustrated in FIG. 5(*b*), the sound transmission device 10 can be regarded as a series circuit of a capacitor A having the insulator 11 as a dielectric layer and a capacitor B having the stratum corneum 310 as a dielectric layer.

In a case where the sound transmission device 10 brought into contact with the human body 130 is regarded as the series circuit of the capacitor A and the capacitor B, when a driving voltage V is applied to the series circuit, a voltage V1 will be applied to the insulator 11 of the capacitor A, and a voltage V2 will be applied to the stratum corneum 310 of the capacitor B. Therefore, the skin of the human body 130 will vibrate by electrostatic force caused by the voltage V2 applied to the stratum corneum 310. In other words, the sound transmission device 10 transmits a sound through vibration using electrostatic force, and when the driving voltage V is applied, the skin like a thin film vibrates due to the electrostatic force to generate a sound, making it possible to listen to the sound.

In the equivalent circuit of the sound transmission device 10, the voltage V2 is represented by $V2=V/(1+(C2/C1))$, where "C1" represents a capacitance of the capacitor A and "C2" represents a capacitance of the capacitor B. Therefore, as the capacitance C1 increases, the voltage V2 increases, and thus the electrostatic force caused by the voltage V2 also becomes stronger. When the electrostatic force that vibrates the skin can be made stronger, the sound transmitted through the human body 130 can be increased, and conversely, when the sound of the same level is transmitted, the driving voltage V can be lowered. That is, increasing the capacitance C1 means increasing the dielectric constant of the insulator 11, and allows the driving voltage V to be lowered.

More specifically, changing a material for the insulator 11 from a polyimide film to another material having a different dielectric constant will be described. The present embodiment will describe a case of changing the material for the insulator 11 to ceramics as one example. A low dielectric constant ceramic material and a high dielectric constant ceramic material are prepared as ceramics used for the material for the insulator 11. Then, driving voltages (audible voltages) are evaluated at which it is possible to listen to sounds in the audible range with the sound transmission devices 10 formed of the two ceramic materials.

As the low dielectric constant ceramic material, so-called low-temperature co-fired ceramics (LTCC) including a mixture of glass and filler ($SiO_2$, $Al_2O_3$, and the like) is used. Dielectric constants of the prepared low-temperature co-fired ceramics are three types: 4.5, 8.8, and 50. Meanwhile, as the high dielectric constant ceramic material, $SrTiO_3$ and $BaTiO_3$ used as capacitors are used. Dielectric constants of the prepared high dielectric constant ceramic materials are four types: 240 ($SrTiO_3$), 1150 ($BaTiO_3$), 3500 ($BaTiO_3$), and 10500 ($BaTiO_3$).

These ceramic materials are kneaded with an organic substance such as a binder and then formed into a tablet shape by extrusion molding. Subsequently, an electrode that becomes the conductor 12 (Ag or Cu for a low dielectric constant ceramic material, Ni for a high dielectric constant ceramic material ($SrTiO_3$ or $BaTiO_3$)) is evaporated on the tablet-shaped ceramic material and fired at a temperature according to each material. For example, for the low dielectric constant ceramic material, the firing temperature is 1000° C. or less, and for the high dielectric constant ceramic material, the firing temperature is higher than 1000° C. A resultant sintered body is polished to make the thickness of the insulator 11 about 50 μm, and then cut into a size of 10 mm around by a method such as cutting with a dicing machine. Connecting the wire 13 to the conductor 12 with solder will provide the sound transmission device 10 illustrated in FIG. 1.

Figure 6:
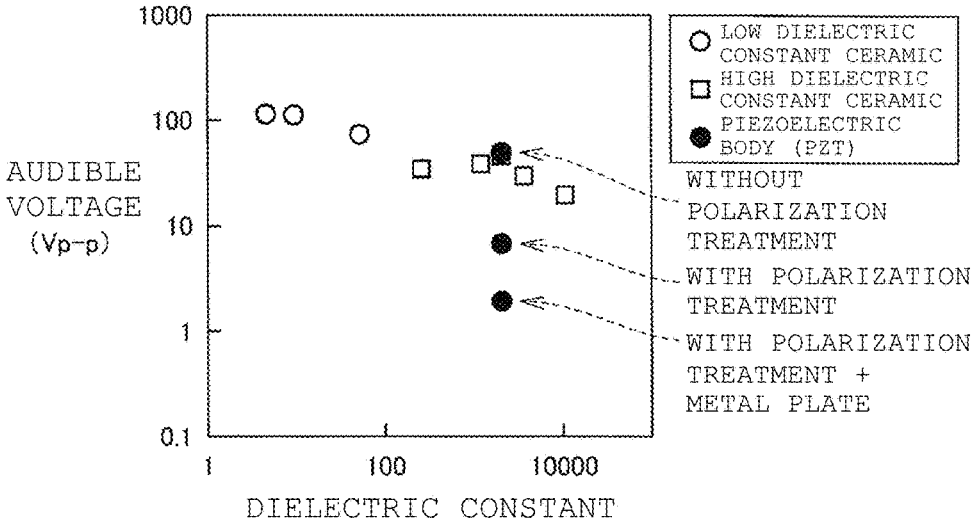
FIG. 6 is a diagram for describing a relationship between a dielectric constant and an audible voltage in the sound transmission device according to the first exemplary embodiment.

The resultant sound transmission device 10 is connected to the sound signal generation device 120 to construct the sound transmission system 100 illustrated in FIG. 2. Then, the driving voltage at which it is possible to listen to a sound in the audible range is evaluated. FIG. 6 is a diagram for describing a relationship between the dielectric constant and the audible voltage in the sound transmission device according to the first exemplary embodiment. In FIG. 6, a horizontal axis represents the dielectric constant and a vertical axis represents the audible voltage (Vp-p), and evaluation results of the sound transmission devices 10 (three types) using the low dielectric constant ceramic material and the sound transmission devices 10 (four types) using the high dielectric constant ceramic material are plotted. For example, for the sound transmission device 10 using a low dielectric constant ceramic material having a dielectric constant of 4.5, the audible voltage is about 100 Vp-p. Meanwhile, for the sound transmission device 10 using a high dielectric constant ceramic material having a dielectric constant of 10500, the audible voltage is about 20 Vp-p. It is noted that the evaluated audible voltages are an average of data of a plurality of subjects. All of the resultant sound transmission devices 10 have acknowledged the sound by adjusting the voltages. Meanwhile, as the dielectric constant increases, the audible voltage decreases.

Figure 7A:
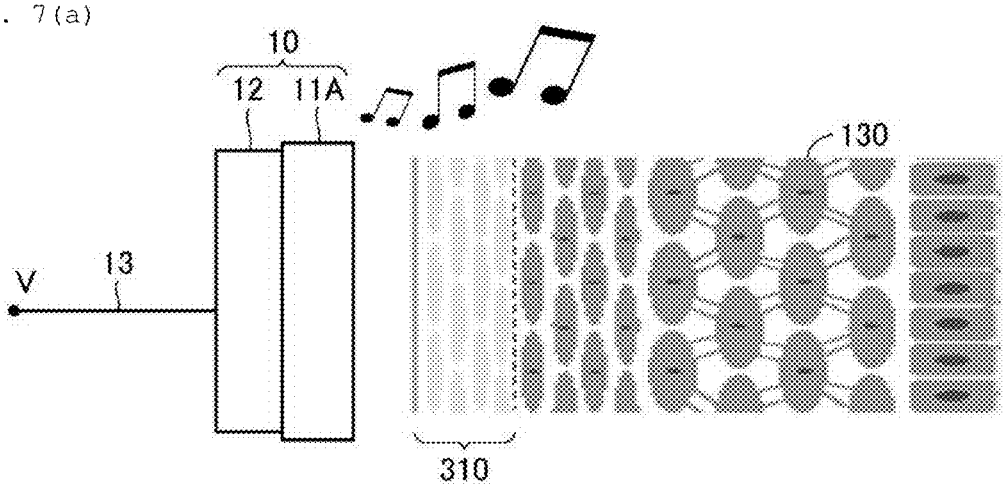
FIGS. 7(*a*) and 7(*b*) are a conceptual diagram and an equivalent circuit diagram of the sound transmission device using a piezoelectric body according to the first exemplary embodiment.
Figure 7B:
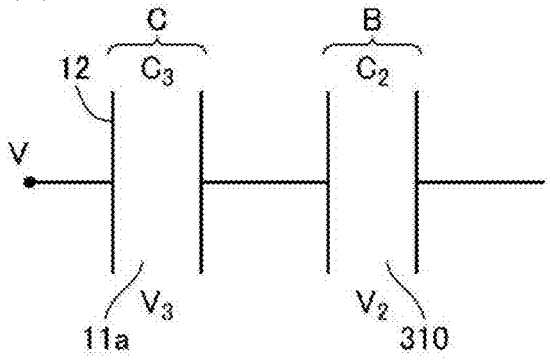

The sound transmission device 10 that transmits a sound to the human body 130 by vibrating the skin by stronger electrostatic force by increasing the dielectric constant of the insulator 11 has been described. Meanwhile, using a piezoelectric body instead of the insulator 11 makes it possible to use vibration of the piezoelectric body itself in addition to skin vibration caused by electrostatic force. FIG. 7 is a conceptual diagram and an equivalent circuit diagram of the sound transmission device using a piezoelectric body according to the first exemplary embodiment. As illustrated in FIG. 7(*a*), the piezoelectric body 11A of the sound transmission device 10 (for example, Pb (Ti, Zr)$O_3$) comes into contact with the stratum corneum 310 of the skin of the human body 130. The stratum corneum 310 can be regarded as an insulating layer having a thickness of 10 μm to 20 μm. Therefore, when the sound transmission device 10 is brought into contact with the human body 130, as in the equivalent circuit illustrated in FIG. 7(*b*), the sound transmission device 10 can be regarded as a series circuit of a capacitor C having the piezoelectric body 11A as a dielectric layer and a capacitor B having the stratum corneum 310 as a dielectric layer.

According to an exemplary aspect, when the sound transmission device 10 brought into contact with the human body 130 is regarded as the series circuit of the capacitor C and the capacitor B, when the driving voltage V is applied to the series circuit, a voltage V3 will be applied to the piezoelectric body 11A of the capacitor C, and a voltage V2 will be applied to the stratum corneum 310 of the capacitor B. Therefore, the skin of the human body 130 will vibrate by electrostatic force caused by the voltage V2. Furthermore, since the voltage V3 is applied to the piezoelectric body 11A, the piezoelectric body 11A itself will vibrate. Therefore, the sound transmission device 10 using the piezoelectric body 11A can transmit a sound to the human body 130 and make it possible to listen to the sound by adding vibration of the piezoelectric body 11A itself in addition to the vibration caused by electrostatic force. It is noted that the vibration of the piezoelectric body 11A itself is larger than the vibration caused by electrostatic force. Therefore, the sound transmission device 10 using the piezoelectric body 11A can make the sound transmitted through the human body 130 larger than the sound of the sound transmission device 10 using the insulator 11. That is, the sound transmission device 10 using the piezoelectric body 11A can make the driving voltage V lower than the sound transmission device 10 using the insulator 11.

More specifically, the sound transmission device 10 using the piezoelectric body 11A is produced using Pb(Zr, Ti)O3 as a material by the same method as producing the sound transmission device 10 using the ceramic material described above. At this time, the sound transmission device 10 that is subjected to polarization treatment to the material to be used (Pb(Zr, Ti)O3) and the sound transmission device 10 that is not subjected to the polarization treatment are obtained. The resultant sound transmission device 10 is connected to the sound signal generation device 120 to construct the sound transmission system 100 illustrated in FIG. 2. Then, the driving voltage that makes it possible to listen to the sound in the audible range is evaluated. A result of the evaluation is plotted in FIG. 6 as described above. In the sound transmission device 10 that has not been subjected to the polarization treatment, the dielectric constant is about 2000 and the audible voltage is about 47 Vp-p. Meanwhile, in the sound transmission device 10 that has been subjected to the polarization treatment, the audible voltage drops to about 6.8 Vp-p.

Figure 8:
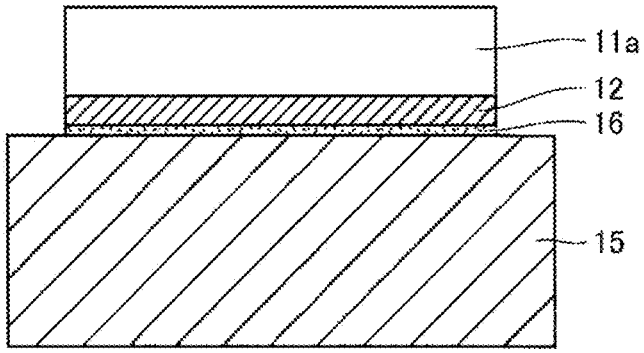
FIG. 8 is a cross-sectional view when a metal plate is added to the sound transmission device using the piezoelectric body according to the first exemplary embodiment.

In the sound transmission device 10 using the piezoelectric body 11A, attaching a metal plate to the conductor 12 is considered in order to further increase the vibration on a side in contact with the human body 130. FIG. 8 is a cross-sectional view when a metal plate is added to the sound transmission device using the piezoelectric body according to the first exemplary embodiment. In the sound transmission device 10 illustrated in FIG. 8, a metal plate 15 having a thickness of 200 μm is bonded to a surface opposite to a surface in contact with the piezoelectric body 11A with an adhesive 16. It is noted that the piezoelectric body 11A provided with the metal plate 15 has been subjected to polarization treatment. The sound transmission device 10 provided with the metal plate 15 is connected to the sound signal generation device 120 to construct the sound transmission system 100 illustrated in FIG. 2, and the driving voltage that makes it possible to listen to the sound in the audible range is evaluated. A result of the evaluation is plotted in FIG. 6, which indicates that the audible voltage has dropped to about 2 Vp-p.

As described above, when the sound transmission device 10 uses the piezoelectric body 11A, the sound transmission system 100 generates a sound by using the vibration of the element and the vibration of the skin, such that the sound is transmitted to the inner ear with air interposed therebetween (air conduction sound), thereby making it possible to listen to the sound in response to the sound signal. It is noted that the sound transmission device 10 is worn on the skin around the ear, but when the sound transmission device 10 is worn near a bone including a cartilage or the like, it is possible to listen to the sound in response to the sound signal by a bone conduction sound produced by the vibration of the element transmitted through the bone and the air conduction sound. Meanwhile, for a bone conduction speaker, by wearing the bone conduction speaker near the bone including the cartilage and the like, it is possible to listen to the sound in response to the sound signal by the bone conduction sound produced by the vibration of the speaker (element) transmitted through the bone. Even for the bone conduction speaker, some air conduction sound is transmitted from the speaker to the inner ear with air interposed therebetween, but the air conduction sound is small. Therefore, for the bone conduction speaker, it is not possible to listen to a sound unless the bone conduction speaker is worn near the bone including the cartilage and the like. However, for the sound transmission system 100, the sound transmission device 10 should be worn on the skin around the ear, and have a high flexibility for wearing.

Also, for an earphone, the earphone is worn by inserting the earphone into the ear and the vibration of the speaker (element) is transmitted to the inner ear through the air (air conduction sound), thereby making it possible to listen to the sound in response to the sound signal. Therefore, since the earphone blocks the ear, it is difficult to listen to a sound emitted other than from the speaker due to the sound from the speaker (element), and thus it is not possible to listen to both sounds simultaneously. Meanwhile, in the sound transmission system 100, since the sound transmission device 10 does not block the ear, it is possible to simultaneously listen to the sound from the sound transmission device 10 and the sound emitted other than from the sound transmission device 10.

Furthermore, in a device such as the bone conduction speaker and the earphone, when the driving voltage based on the sound signal is input into the speaker (element), vibration will start. However, in the sound transmission device 10, vibration is not produced at all only by inputting the driving voltage based on the sound signal into the conductor 12, and vibration is started only by bringing the sound transmission device 10 into contact with the human body 130. That is, in the sound transmission system 100, when the sound transmission device 10 is in contact with the human body 130, the conductive path illustrated in FIG. 2 is formed and vibration is produced by the sound transmission device 10, making it possible to transmit the sound to the human body 130 and to listen to the sound. Therefore, in the sound transmission system 100, no vibration is produced by the sound transmission device 10 except when the sound transmission device 10 is in contact with the human body 130. Therefore, the sound transmission system 100 can reduce power consumption.

Figure 9:
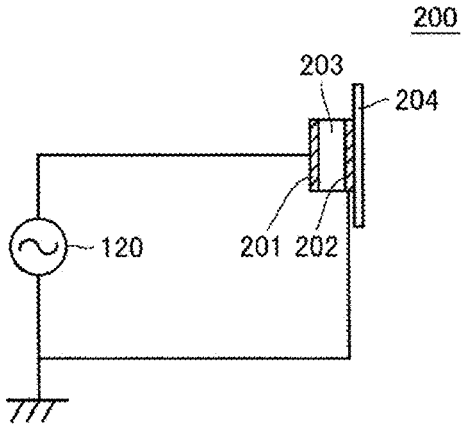
FIG. 9 is an equivalent circuit of a piezoelectric speaker.

Here, the sound transmission system 100 according to the present embodiment is compared with a piezoelectric speaker. FIG. 9 is an equivalent circuit of a piezoelectric speaker. As illustrated in FIG. 9, in the piezoelectric speaker 200, a piezoelectric body 203 is interposed between two electrode plates 201 and 202, and a diaphragm 204 is attached to one electrode plate 202. In the piezoelectric speaker 200, two wires extending from the two electrode plates 201 and 202 are connected to the sound signal generation device 120. In the piezoelectric speaker 200, when a driving voltage based on a sound signal from the sound signal generation device 120 is input into the two electrode plates 201 and 202, the piezoelectric body 203 vibrates and transmits the vibration to the diaphragm 204, thereby generating a sound. Here, the piezoelectric speaker 200 may use the diaphragm 204 not only to propagate the vibration of the piezoelectric conducting material conducting material body 203, but also to cause the diaphragm 204 to resonate naturally. Of course, the piezoelectric speaker 200 may use the diaphragm 204 to cause the diaphragm 204 to resonate naturally, while using the diaphragm 204 in order to propagate the vibration of the piezoelectric body 203.

As described above, the piezoelectric speaker 200 has a structure that does not make it possible to listen to a sound without the two electrode plates 201 and 202 and two wires extending from the electrode plates 201 and 202. Meanwhile, in the sound transmission system 100 according to the present embodiment, the sound transmission device 10 has a structure in which one wire 13 is connected to one conductor 12 that is in contact with the insulator 11, which is clearly different from the piezoelectric speaker 200 in structure.

As described above, in the sound transmission system 100 according to the present embodiment, the sound transmission device 10 includes the insulator 11 having a contact surface (first portion 11*a*) that is brought into contact with the human body, the conductor 12 that is in contact with the surface on the opposite side of the contact surface of the insulator 11 (second portion 11*b*), and the input portion 14 that inputs the driving voltage based on the sound signal into the surface of the conductor 12 on the opposite side of the surface that is in contact with the insulator 11. Therefore, the sound transmission device 10 vibrates only by the skin touching the insulator 11, allowing transmission of the sound. Furthermore, in the sound transmission system 100, the sound transmission device 10 is worn on the skin around the ear without blocking the ear. This makes it possible to listen to the sound from the sound transmission device 10 while listening to a sound emitted other than from the sound transmission device 10. In addition, the sound transmission system 100 does not unnecessarily generate a sound in the surroundings, and discomfort of wearing the sound transmission device 10 is small. It is noted that the surface of the conductor 12 that is in contact with the insulator 11 is not limited to the surface opposite to the contact surface of the insulator 11. As long as the conductor 12 is not in contact with the human body, the surface of the conductor 12 that is in contact with the insulator 11 may be a surface different from the surface opposite to the contact surface of the insulator 11. Also, the surface on which the input portion 14 is formed is not limited to the surface of the conductor 12 on the opposite side of the surface in contact with the insulator 11. The surface may be any place on the conductor 12 as long as the place is electrically connected.

Also, the sound transmission device 10 according to the present embodiment includes one layer of the insulator 11 and one layer of the conductor 12, has a very simple structure, and can be easily made thin and small. Therefore, the sound transmission device 10 is suitable for use as a device specialized in design quality and fitting property, or a sound output unit of a wearable device. For example, if the sound transmission device 10 is a type that is worn by sticking the device to the ear lobe (ear tab) with a seal or holding the device with a clip, it is possible to listen to a sound without blocking the ear. Therefore, the sound transmission device 10 of this type allows recognition of a sound emitted other than from the sound transmission device 10, leading to safety.

Furthermore, as described above, changing the dielectric constant of the insulator 11 makes it possible to adjust the sound level transmitted by the sound transmission device 10. In addition, if the audible voltage that is input into the sound transmission device 10 can be reduced, a circuit necessary for high voltage application becomes unnecessary and the circuit configuration can be made small.

It has been described that in the sound transmission device 10 illustrated in FIG. 1, the insulator 11 and the conductor 12 are formed to have the same size. However, since there is a possibility of an electric shock when the conductor 12 is brought into contact with the human body, it is preferable from the viewpoint of safety that the insulator 11 be larger in area than the conductor 12. Even if the insulator 11 and the conductor 12 have the same size, it is possible to reduce the possibility of an electric shock by covering, with an insulating resin, the surface of the conductor 12 on the opposite side of the side that is in contact with the insulator 11.

It is noted that the insulator 11 included in the sound transmission device 10 may be an organic material or an inorganic material. The insulator 11 should at least be a generally used insulating resin, an insulating ceramic material, or a dielectric material. From the ease of forming the electrode that is the conductor 12, a resin material or a ceramic material used in electronic components and electric circuit substrates may be used. Examples of the material for the insulator 11 include a super engineering plastic such as polyimide, polyamide, and liquid crystal polymer, an insulating resin such as epoxy and silicone, and an insulating material such as Al2O3, glass, LTCC, ZrO2, TiO2, BaTiO3, and PZT, and a dielectric ceramic. The material for the conductor 12 is required at least to conduct electricity, and includes, for example, Cu, Ag, Al, RuO2, W, Mo, Ni, Fe, and the like.

Furthermore, in the sound transmission device 10, the structure has been described in which the conductor 12 is formed on one surface of the insulator 11 and the wire 13 is connected to the conductor 12 with solder. However, the connection between the conductor 12 and the wire 13 is not limited to solder connection, and any method may be used as long as the connection is made electrically. For example, as a method of connecting the conductor 12 to the wire 13, a conductive adhesive, a conductive tape, or the like may be used.

Second Embodiment

The sound transmission device 10 according to the first embodiment has a configuration in which the conductor 12 is formed on one surface of the insulator 11 and the wire 13 is connected to the conductor 12 with solder. However, when actually using the sound transmission device 10, it is necessary to take measures from the viewpoint of reliability, such as prevention of water resistance into the insulator 11. Therefore, in a second embodiment, a packaged sound transmission device such as a device covered with an insulating resin will be described.

FIG. 10 is a cross-sectional view of a sound transmission device according to the second exemplary embodiment and a conceptual diagram when the sound transmission device is worn. It is noted that in FIG. 10, components described in the first embodiment are denoted with the same reference signs, and detailed descriptions thereof will be omitted. The same applies to the following drawings. In the sound transmission device 20 illustrated in FIG. 10(*a*), an insulator 11 and a conductor 12 are covered with a resin film 21, and an adhesive layer 22 is provided on a surface of the conductor 12 that is in contact with a human body 130. It is noted that the adhesive layer 22 is formed on the surface of the conductor 12 with the resin film 21 interposed therebetween. In addition, a wire 13 is connected to the conductor 12 with solder, passes through the resin film 21, and is drawn out.

By using the adhesive layer 22 as illustrated in FIG. 10(*b*), the sound transmission device 20 can be stuck and worn on an earlobe (ear tab). Not that a location on which the sound transmission device 20 is stuck is not limited to the earlobe (ear tab), but may be a skin around an ear such as a helix and temple. By sticking the sound transmission device 20 on the earlobe (ear tab) by using the adhesive layer 22, vibration of the insulator 11 starts and a sound is heard. By peeling off the sound transmission device 20, the vibration of the insulator 11 stops and the sound is not heard.

The sound transmission device 20 includes the resin film 21 and the adhesive layer 22 between the insulator 11 and the human body 130. In a similar manner to the sound transmission device 10 according to the first embodiment, bringing the sound transmission device 20 into contact with the human body 130 makes it possible to listen to a sound. This makes it possible to provide the sound transmission device 20 that can be easily removed from the skin around the ear. In addition, unlike an earphone that blocks the ear, in the sound transmission device 20, a sound from a sound signal generation device 120 does not prevent a sound emitted other than from the sound signal generation device 120 from being heard, making it possible to fully perceive ambient sounds.

In addition, the feeling of wearing the sound transmission device 20 does not differ depending on the age and gender of a person, making it possible to provide a good feeling of wearing to many people. For example, for an earphone, there are people from whom the earphone is easily detached or people who are difficult to wear the earphone due to a difference in size of the ear, and for a headphone, there are people who feel too tight by the size of the head and people from whom the headphone is easily displaced. The sound transmission device 20, which is just stuck on the skin around the ear, can solve the difference in feeling of wearing caused by the difference in the physique of the exemplified person.

Third Embodiment

In the sound transmission system 100 illustrated in FIG. 2, the configuration has been described in which one sound transmission device 10 is connected to one sound signal generation device 120. However, the number of sound transmission devices to be connected to one sound signal generation device 120 is not limited to one, and a plurality of sound transmission devices may be connected. Therefore, in a third embodiment, a sound transmission system in which a plurality of sound transmission devices is connected to one sound signal generation device will be described. It is noted that in the following description, a sound transmission system in which two sound transmission devices are connected to one sound signal generation device will be described as an example. However, three or more sound transmission devices may be connected to one sound signal generation device.

Figure 11A:
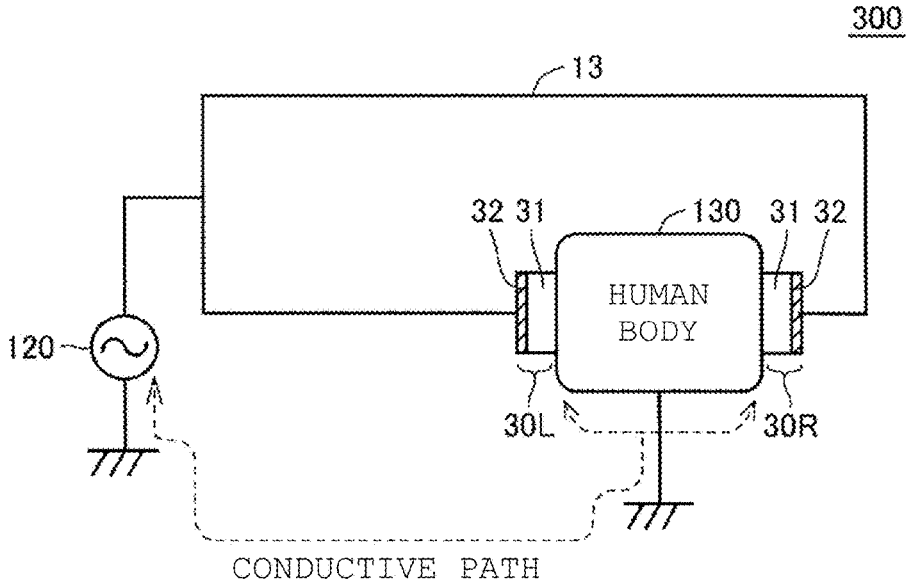
FIG. 11(*a*) is a schematic diagram of a sound transmission system according to a third exemplary embodiment, and FIG. 11(*b*) is a plan view and FIG. 11(*c*) is a cross-sectional view of a sound transmission device used in the sound transmission system.
Figure 11B:
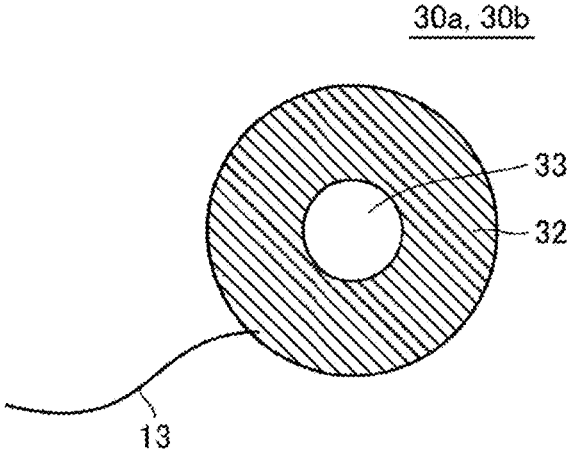
Figure 11C:
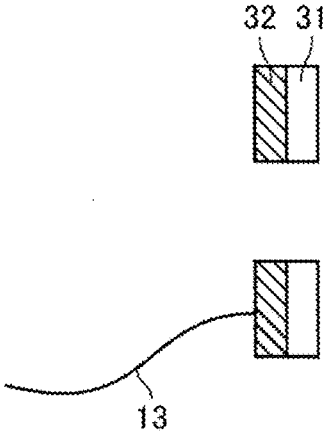

FIG. 11 is a schematic diagram of a sound transmission system according to the third exemplary embodiment, and a plan view and a cross-sectional view of a sound transmission device used in the sound transmission system. In the sound transmission system 300 illustrated in FIG. 11(*a*), one end of a sound signal generation device 120 is connected to a sound transmission device 30L and a sound transmission device 30R, and the other end of the sound signal generation device 120 is grounded. For example, in the sound transmission system 300, the sound transmission device 30L is worn on a skin around a left ear of a human body 130, whereas the sound transmission device 30R is worn on a skin around a right ear of the human body 130. That is, the sound transmission system 300 has a configuration in which speaker portions of a headphone are replaced with the sound transmission devices 30L and 30R. It is noted that by grounding the human body 130, a conductive path indicated by a broken line is formed, making it possible to form the sound transmission system in which a sound is transmitted to the human body 130. With this configuration, in the sound transmission system 300, a driving voltage based on the same sound signal is input from one sound signal generation device 120 into the left and right sound transmission devices 30L and 30R, making it possible to listen to a monophonic sound by both of the ears.

The sound transmission devices 30L and 30R are donut-shaped sound transmission devices, different in shape from the tablet-shaped sound transmission device 10 illustrated in FIG. 1. As illustrated in the plan view of FIG. 11(*b*) and the cross-sectional view of FIG. 11(*c*), the sound transmission devices 30L and 30R each have a configuration in which a donut-shaped conductor 32 is provided on one surface of an insulator 31 formed in the same donut shape, and a wire 13 is connected to the conductor 32 with solder. The sound transmission devices 30L and 30R each have a donut shape and therefore have a hole portion 33. When the sound transmission devices 30L and 30R are each worn on the ear at a position where the hole portion 33 and the ear canal overlap each other, the sound transmission devices 30L and 30R each do not block the ear canal. Therefore, the donut-shaped sound transmission devices 30L and 30R each make it possible to listen to a sound emitted other than from the sound transmission devices 30L and 30R through the hole portion 33, while covering the entire ear and securing a wide contact area with the human body 130.

Figure 12:
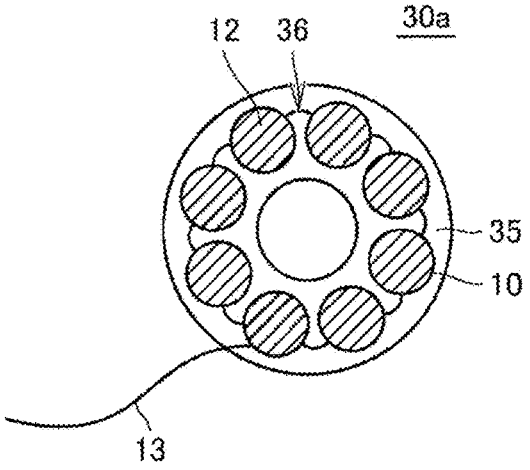
FIG. 12 is a plan view of a sound transmission device according to a modification of the third exemplary embodiment.

The sound transmission device is not limited to the donut-shaped sound transmission devices 30L and 30R, but can be formed in various shapes. In addition, instead of forming the donut-shaped sound transmission devices 30L and 30R by making the conductor and the insulator into a donut shape, a donut-shaped sound transmission device may be formed by combining a plurality of sound transmission devices. FIG. 12 is a plan view of a sound transmission device according to a modification of the third exemplary embodiment. In the sound transmission device 30*a* illustrated in FIG. 12, eight sound transmission devices 10 illustrated in FIG. 1 are mounted on a donut-shaped substrate 35, and the sound transmission devices 10 are connected in parallel with a conducting wire 36. A wire 13 is connected to a conductor 12 of one sound transmission device 10 with solder. In FIG. 12, the conductors 12 of the sound transmission devices 10 are illustrated on a front surface of paper, and thus insulators of the sound transmission devices 10 on a back surface of paper are not illustrated. It is noted that it has been described that the sound transmission device 30*a* has a configuration in which eight tablet-shaped sound transmission devices 10 are mounted, but the shape and the number of sound transmission devices to be mounted are not limited thereto. The shape of the sound transmission device to be mounted may be quadrangular, and the number of sound transmission devices to be mounted may be four.

In addition, the sound transmission device may be a type that is worn by turning from the neck side like a sports headphone. When the sound transmission devices 30L, 30R, and 30*a* are used, these devices can be worn without blocking the ear canal, and thus a more comfortable feeling of wearing can be provided. In addition, since the ear canal is not blocked, a sound emitted other than from the sound transmission devices 30L, 30R, and 30*a* can be perceived, and for example, when a person is riding a bicycle, the sound transmission devices 30L, 30R, and 30*a* have advantages over ordinary earphones and the like in terms of safety. Of course, the sound transmission devices 30L, 30R, and 30*a* are not limited to the use of replacing a speaker portion of the headphone, but can be installed within a helmet, for example. By installing the sound transmission devices 30L, 30R, and 30*a* within a helmet, it is possible to wear the sound transmission devices 30L, 30R, and 30*a* on the skin around the ear only by wearing the helmet. The helmet having the sound transmission devices 30L, 30R, and 30*a* makes it possible to listen to a sound from the sound transmission devices while recognizing a sound emitted other than from the sound transmission devices 30L, 30R, and 30*a* such as a sound of other vehicles, providing a high level of safety.

As described above, in the sound transmission system 300 according to the present third embodiment, the sound transmission device 30L is connected to one end of the sound signal generation device 120 and another sound transmission device 30R is connected to the other end of the sound signal generation device 120, making it possible to listen to a monophonic sound by both ears.

Fourth Embodiment

In the sound transmission system 300 illustrated in FIG. 11(*a*), the configuration has been described in which two sound transmission devices 30L and 30R are connected to one sound signal generation device 120. However, the number of sound signal generation devices is not limited to one, and a plurality of sound signal generation devices may be provided. Therefore, in a fourth embodiment, a sound transmission system in which sound transmission devices are connected to two sound signal generation devices will be described. It is noted that in the following description, a sound transmission system in which two sound signal generation devices are provided will be described as an example. However, three or more sound signal generation devices may be provided.

Figure 13:
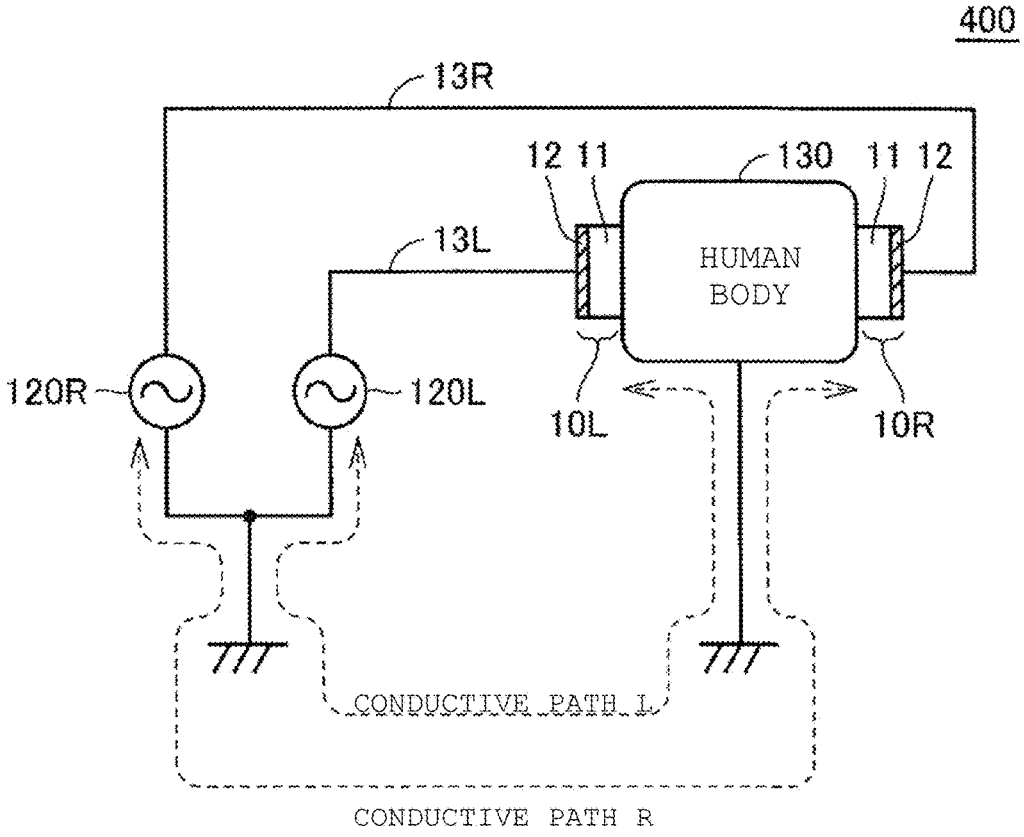
FIG. 13 is a schematic diagram of a sound transmission system according to a fourth exemplary embodiment.

FIG. 13 is a schematic diagram of a sound transmission system according to the fourth exemplary embodiment. In the sound transmission system 400 illustrated in FIG. 13, two sound signal generation devices 120L and 120R are provided, a sound transmission device 10L is connected to one end of the sound signal generation device 120L with a wire 13L, and a sound transmission device 10R is connected to one end of the sound signal generation device 120R with a wire 13R. A conductive path L and a conductive path R illustrated in FIG. 13 are formed by grounding and electrically connecting the other ends of the sound signal generation devices 120L and 120R and a human body 130 that is in contact with the sound transmission devices 10L and 10R.

In the sound transmission system 400, for example, the sound transmission device 10L is worn on a skin around a left ear of the human body 130, whereas the sound transmission device 10R is worn on a skin around a right ear of the human body 130. With this configuration, in the sound transmission system 400, a driving voltage based on a sound signal from the sound signal generation device 120L is input into the left sound transmission device 10L, whereas a driving voltage based on a sound signal from the sound signal generation device 120R is input into the right sound transmission device 10R. Therefore, in the sound transmission system 400, it is possible to listen to, from the sound transmission device 10L, a sound based on the sound signal from the sound signal generation device 120L, whereas it is possible to listen to, from the sound transmission device 10R, a sound based on the sound signal from the sound signal generation device 120R. Therefore, it is possible to listen to the sounds from the sound transmission devices 10L and 10R by the left and right ears, respectively.

As described above, in the sound transmission system 400 according to the present fourth embodiment, one sound transmission device 10L is connected to one sound signal generation device 120L, and one sound transmission device 10R is connected to one sound signal generation device 120R, making it possible to listen to a stereo sound by the left and right ears.

Fifth Embodiment

In the sound transmission system 300 illustrated in FIG. 11(*a*), the configuration has been described in which two sound transmission devices 30L and 30R are connected to one sound signal generation device 120, and the two sound transmission devices 30L and 30R are worn on one person (human body 130). However, the sound transmission system 300 is not limited to a case where two sound transmission devices are worn on one person, and sound transmission devices may be worn on a plurality of persons. Therefore, in a fifth embodiment, a sound transmission system in which sound transmission devices are worn on two persons will be described. It is noted that in the following description, a sound transmission system in which sound transmission devices are worn on two persons will be described as an example. However, sound transmission devices may be worn on three or more persons.

Figure 14:
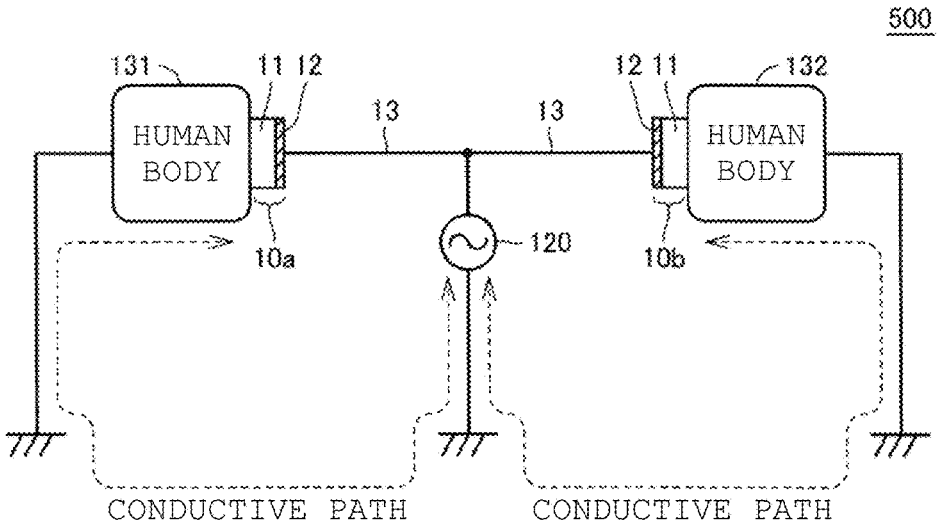
FIG. 14 is a schematic diagram of a sound transmission system according to a fifth exemplary embodiment.

FIG. 14 is a schematic diagram of a sound transmission system according to the fifth exemplary embodiment. In the sound transmission system 500 illustrated in FIG. 14, two sound transmission devices 10*a* and 10*b* are connected to one end of one sound signal generation device 120 with a wire 13, and the sound transmission device 10*a* is worn on a human body 131 and the sound transmission device 10*b* is worn on a human body 132. The other end of the sound signal generation device 120 and the human bodies 131 and 132 that are respectively in contact with the sound transmission devices 10*a* and 10*b* are grounded and electrically connected.

In the sound transmission system 500, a driving voltage based on a sound signal from the sound signal generation device 120 is input into the sound transmission devices 10*a* and 10*b*, such that separate persons (human bodies 131 and 132) can listen to sounds based on the sound signal. Increasing the number of sound transmission devices connected to the sound signal generation device 120 makes it possible to transmit sounds from the sound signal generation device 120 to more persons.

As described above, in the sound transmission system 500 according to the present fifth embodiment, the plurality of sound transmission devices 10*a* and 10*b* are connected in parallel to one sound signal generation device 120, making it possible for the plurality of persons to simultaneously listen to the same sound from the sound signal generation device 120 that is one sound source.

Sixth Embodiment

In the sound transmission system 300 illustrated in FIG. 11(*a*), the configuration has been described in which two sound transmission devices 30L and 30R are connected to one sound signal generation device 120. However, the sound transmission system 300 is not limited to a case where two sound transmission devices are connected to one sound signal generation device. One sound transmission device may be connected to the sound signal generation device and the other sound transmission device may be connected to a ground electrode. Therefore, in a sixth embodiment, a sound transmission system in which one sound transmission device is connected to a sound signal generation device and the other sound transmission device is connected to a ground electrode will be described.

Figure 15:
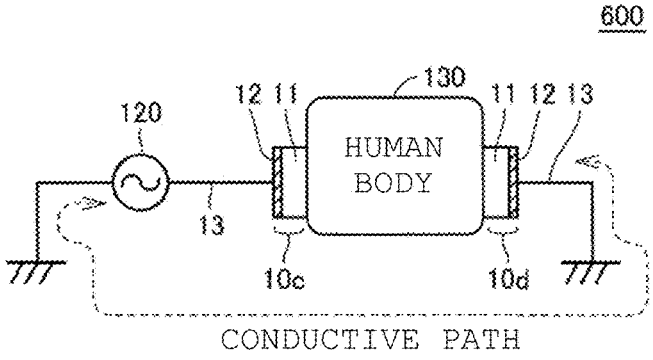
FIG. 15 is a schematic diagram of a sound transmission system according to a sixth exemplary embodiment.

FIG. 15 is a schematic diagram of a sound transmission system according to the sixth exemplary embodiment. In the sound transmission system 600 illustrated in FIG. 15, one sound signal generation device 120 is provided, a sound transmission device 10*c* is connected to one end of the sound signal generation device 120 with a wire 13, and a sound transmission device 10*d* is connected to a ground electrode with the wire 13. A conductive path illustrated in FIG. 15 is formed by grounding and electrically connecting the other end of the sound signal generation device 120 and the wire 13 from the sound transmission device 10*d*. In the sound transmission system 600, the conductive path is not formed only by wearing the sound transmission device 10*d* on a human body 130, and the conductive path is formed by the human body 130 touching the sound transmission device 10*c*.

In the sound transmission system 600, the conductive path is formed, for example, by wearing the sound transmission device 10*d* on a skin around an ear of the human body 130, and the human body 130 (for example, right hand) touching an insulator 11 of the sound transmission device 10*c* connected to one end of the sound signal generation device 120. That is, the sound transmission device 10*d* worn on the skin around the ear of the human body 130 and the other end of the sound signal generation device 120 are connected to each other with the ground electrode interposed therebetween. Therefore, in the sound transmission system 600, while the human body 130 is in contact with the insulator 11 of the sound transmission device 10*c*, it becomes possible to listen to, from the sound transmission device 10*d*, a sound based on a sound signal from the sound signal generation device 120.

In the sound transmission system 600, it is possible to listen to the sound from the sound signal generation device 120 simply by wearing the sound transmission device 10*d* that is not directly connected to the sound signal generation device 120 on the skin around the ear and touching the sound transmission device 10*c*. For example, the sound transmission system 600 can be used for explaining an exhibit such as an exhibit in a museum or art museum. More specifically, the sound transmission device 10*c* to which a driving voltage based on the sound signal from the sound signal generation device 120 is applied is placed near the exhibit. Then, when a person wearing the sound transmission device 10*d* on the skin around the ear touches a contact portion of the sound transmission device 10*c* placed near the exhibit, the person can listen to the sound explaining the exhibit. Furthermore, even when a person wearing the sound transmission device 10*d* on the skin around the ear comes into contact with another person who touches the sound transmission device 10*c* to which the driving voltage based on the sound signal from the sound signal generation device 120 is applied, the person wearing the sound transmission device 10*d* can listen to the sound from the sound signal generation device 120.

As described above, in the sound transmission system 600 according to the present sixth embodiment, among the two sound transmission devices 10*c* and 10*d* that are brought into contact with the human body, one sound transmission device 10*c* is connected to one end of the sound signal generation device 120, and the other end of the sound signal generation device 120 and the other sound transmission device 10*d* are grounded and electrically connected. Therefore, while the person wearing the sound transmission device 10*d* is in contact with the sound transmission device 10*c*, the person can listen to the sound from the sound signal generation device 120. It is noted that the sound transmission system 600 may be configured such that the sound transmission device 10*c* connected to one end of the sound signal generation device 120 is worn on a person, and while the person is in contact with the sound transmission device 10*d* connected to the ground electrode, the person can listen to the sound from the sound signal generation device 120.

Seventh Embodiment

In the sound transmission system 600 illustrated in FIG. 15, the configuration has been described in which, by touching the sound transmission device 10*c* connected to one sound signal generation device 120, it is possible to listen to, from the sound transmission device 10*d* worn on a person, the sound from the sound signal generation device 120. However, the number of sound signal generation devices is not limited to one, and a sound transmission system using a plurality of sound signal generation devices may be configured. Therefore, in a seventh embodiment, a sound transmission system using two sound signal generation devices will be described. It is noted that in the following description, a sound transmission system using two sound signal generation devices will be described as an example, but a sound transmission system using three or more sound signal generation devices may be used.

Figure 16:
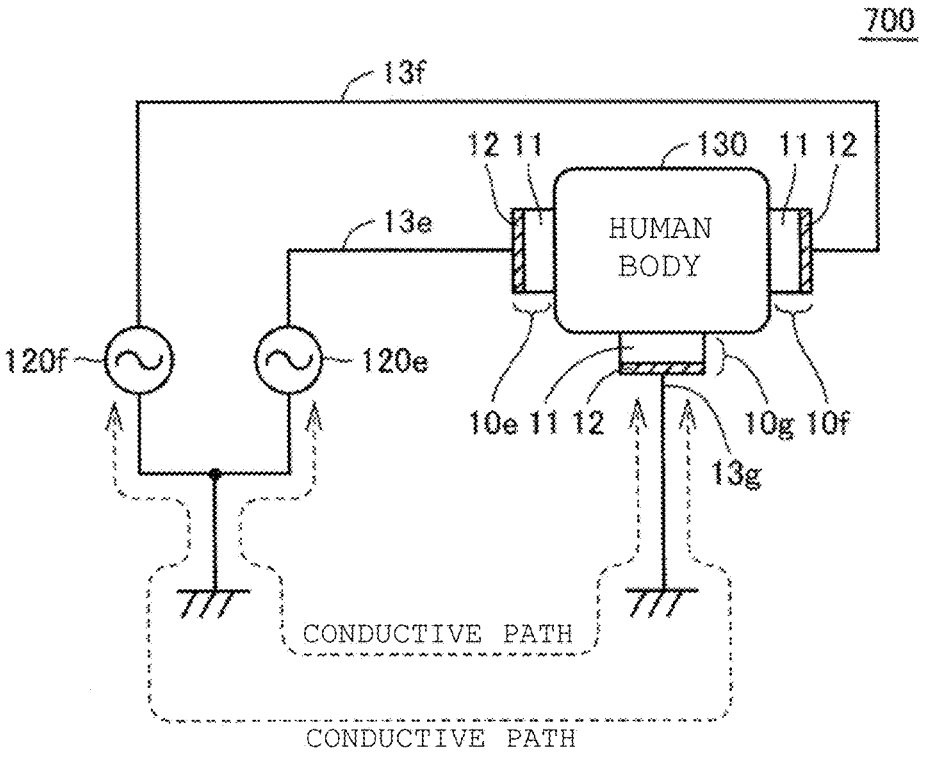
FIG. 16 is a schematic diagram of a sound transmission system according to a seventh exemplary embodiment.

FIG. 16 is a schematic diagram of a sound transmission system according to the seventh exemplary embodiment. In the sound transmission system 700 illustrated in FIG. 16, two sound signal generation devices 120*e* and 120*f* are provided, a sound transmission device 10*e* is connected to one end of the sound signal generation device 120*e* with a wire 13*e*, and a sound transmission device 10*f* is connected to one end of the sound signal generation device 120*f* with a wire 13*f*. In the sound transmission system 700, a sound transmission device 10*g* is connected to a ground electrode with a wire 13*g*. Then, a conductive path illustrated in FIG. 16 is formed by grounding and electrically connecting the other ends of the two sound signal generation devices 120*e* and 120*f* and the wire 13*g* from the sound transmission device 10*g*. In the sound transmission system 700, the conductive path is not formed only by wearing the sound transmission device 10*g* on a human body 130, and the conductive path is formed by the human body 130 touching the sound transmission devices 10*e* and 10*f*. It is noted that when the human body 130 touches only one of the sound transmission devices 10*e* and 10*f*, the sound transmission system 700 has the same configuration as illustrated in FIG. 15.

In the sound transmission system 700, the conductive path is formed, for example, when the sound transmission device 10*g* is worn on the skin around the ear of the human body 130, and the human body 130 (for example, right hand and left hand) touches an insulator 11 of the sound transmission device 10*e* and an insulator 11 of the sound transmission device 10*f*. That is, this causes the sound transmission device 10*g* worn on the skin around the ear of the human body 130 to be connected to the other ends of the sound signal generation devices 120*e* and 120*f* with the ground electrode interposed therebetween. Therefore, in the sound transmission system 700, it is possible to listen to sounds of the two sound signal generation devices 120*e* and 120*f* from the sound transmission device 10*g* while the human body 130 is in contact with the insulators 11 of the two sound transmission devices 10*e* and 10*f*.

In the sound transmission system 700, by wearing the sound transmission device 10*g* that is not directly connected to the two sound signal generation devices 120*e* and 120*f* on the skin around the ear, and by only touching the two sound transmission devices 10*e* and 10*f*, it is possible to listen to the sounds from the two sound signal generation devices 120*e* and 120*f*. The sound transmission system 700 can be used, for example, when it is desired to simultaneously listen to sounds from a plurality of musical instruments for an exhibit such as musical instruments. More specifically, the sound transmission device 10*e* to which a driving voltage based on a sound signal from the sound signal generation device 120*e* is applied is placed near an explanation panel of a musical instrument A (for example, a piano). Also, the sound transmission device 10*f* to which a driving voltage based on a sound signal from the sound signal generation device 120*f* is applied is placed near an explanation panel of a musical instrument B (for example, a violin). Then, by touching a contact portion of the sound transmission device 10*e* placed at the explanation panel of the musical instrument A, a person wearing the sound transmission device 10*g* on the skin around the ear can listen to the sound of the musical instrument A. Also, by touching a contact portion of the sound transmission device 10*f* placed at the explanation panel of the musical instrument B, the person can listen to the sound of the musical instrument B. Furthermore, by simultaneously touching the contact portions of the sound transmission devices 10*e* and 10*f*, the person wearing the sound transmission device 10*g* on the skin around the ear can simultaneously listen to the sounds of the instruments A and B.

As described above, in the sound transmission system 700 according to the present sixth embodiment, among the three sound transmission devices 10*e* to 10*g* that are in contact with the human body 130, two sound transmission devices 10*e* and 10*f* are connected to one ends of the two sound signal generation devices 120*e* and 120*f*, respectively, and the other ends of the two sound signal generation devices 120*e* and 120*f* and the remaining sound transmission device 10*g* are grounded and electrically connected. Therefore, in the sound transmission system 700, while the person wearing the sound transmission device 10*g* is in contact with the two sound transmission devices 10*e* and 10*f*, the person can simultaneously listen to the sounds from the two sound signal generation devices 120*e* and 120*f*. It is noted that the sound transmission system 700 may be configured such that a person wears two sound transmission devices 10*e* and 10*f* connected to one ends of the two sound signal generation devices 120*e* and 120*f*, respectively, and while the person is in contact with the sound transmission device 10*g* connected to the ground electrode, the person can simultaneously listen to the sounds from the two sound signal generation devices 120*e* and 120*f*.

Also, in the sound transmission system 700, even when a person wearing the sound transmission device 10*g* on the skin around the ear touches another person who touches the two sound transmission devices 10*e* and 10*f* to which the driving voltages based on the sound signals from the two sound signal generation devices 120*e* and 120*f* are applied, the person wearing the sound transmission device 10*g* can simultaneously listen to the sounds from the two sound signal generation devices 120*e* and 120*f*.

It is noted that in the sixth and seventh exemplary embodiments, a technique has been described in which the conductive path is formed by touching the sound transmission device and the sound from the sound signal generation device is transmitted. However, this technique is different from the technique related to human body communication. More specifically, the technique described in the sixth and seventh embodiments is a technique for transmitting the sound signal in the audible range by using, as a wire, the conductive path formed by touching the sound transmission device. However, the technique related to human body communication is a technique of propagating various high-frequency signals by using the human body as an antenna. Therefore, the technique described in the sixth and seventh embodiments is a technical field that is clearly different from the technique related to human body communication.

EXAMPLE

Examples of applying the sound transmission systems according to the first to seventh embodiments described above to specific products or the like will be described. The sound transmission systems according to the first to seventh embodiments are divided into a sound transmission system A having a configuration that allows a person to listen to a sound by mainly wearing a sound transmission device connected to a sound signal generation device on the skin around the ear, and a sound transmission system B having a configuration that allows a person to listen to a sound by mainly touching a sound transmission device connected to a sound signal generation device.

The sound transmission systems disclosed in the first to fifth embodiments correspond to the sound transmission system A and can be used as a substitute for conventional earphones, headphones, headsets (including headsets for INCOM) and the like that are used by blocking the ear. More specifically, the sound transmission devices 10 and 20 (refer to FIGS. 1 and 10) described in the first and second embodiments are used as a speaker for a hearing aid and a headset. By using the sound transmission devices 10 and 20 as a speaker for a hearing aid and a headset, it is advantageously possible to provide a more comfortable feeling of wearing to a person having an uncomfortable feeling by inserting the device into the ear canal. In addition, the sound transmission devices 30L and 30R described in the third embodiment (refer to FIG. 11(*b*)) are used as earmuffs for a construction helmet (this may be formed integrally with a helmet or formed separately) and as earmuffs for a cold weather protection device. With this configuration, it is possible to listen to a sound emitted other than from the sound transmission devices 30L and 30R (for example, a navigation sound of machine operation, a surrounding sound, and the like) from the hole portion 33 of the sound transmission devices 30L and 30R. It is also possible to listen to sounds from the sound transmission devices 30L and 30R. Furthermore, the sound transmission devices 10L and 10R described in the fourth embodiment (refer to FIG. 13) are used as an audio headphone. With this configuration, it is possible to listen to a stereo sound similar to a stereo sound of a conventional headphone from the sound transmission devices 10L and 10R by the left and right ears. In addition, the sound transmission devices 10*a* and 10*b* described in the fifth embodiment (refer to FIG. 14) are used as earphones for simultaneous interpretation. This allows many people wearing the sound transmission device 10*a* or 10*b* to listen to a simultaneously interpreted sound.

The sound transmission systems disclosed in the sixth and seventh embodiments correspond to the sound transmission system B, and it is possible to listen to a sound by touching an object at which the sound transmission device is placed. More specifically, as described above, the sound transmission systems 600 and 700 are used for explaining an exhibit such as in a museum and art museum. For example, when a person wearing the sound transmission devices 10*d* and 10*g* on the skin around the ear touches an exhibit at which the sound transmission devices 10*c*, 10*e*, and 10*f* are placed in advance, the person can listen to a sound explaining the exhibit. Similarly, the sound transmission systems 600 and 700 are used for an amusement machine, a game machine, attractions, and the like. For example, when a person wearing the sound transmission devices 10*d* and 10*g* on the skin around the ear touches a device portion of an amusement machine in which the sound transmission devices 10*c*, 10*e*, and 10*f* are placed in advance, the person can listen to tips on the amusement, game, and the like. Also, the sound transmission systems 600 and 700 are used for toys. For example, when a person wearing the sound transmission devices 10*d* and 10*g* on the skin around the ear touches a doll, a game board, or the like in which the sound transmission devices 10*c*, 10*e*, and 10*f* are placed in advance, the person can listen to a voice of the doll or explanation of a sign of the game board.

Furthermore, the sound transmission systems 600 and 700 are used as learning materials. For example, when a person wearing the sound transmission devices 10*d* and 10*g* on the skin around the ear touches a picture in an illustrated reference book or a sample animal at which the sound transmission devices 10*c*, 10*e*, and 10*f* are placed in advance, the person can listen to explanation of the picture in the illustrated reference book or a cry of the animal. Also, the sound transmission systems 600 and 700 are used as a communication tool. For example, when a person wearing the sound transmission devices 10*d* and 10*g* on the skin around the ear touches a leader of a group having the sound transmission devices 10*c*, 10*e*, and 10*f* or a person who joins hands with the leader in advance, the person wearing the sound transmission devices 10*d* and 10*g* can listen to instructions of the group. Furthermore, the sound transmission systems 600 and 700 are used for a facility for supporting handicapped people. For example, when a visually impaired person wearing the sound transmission devices 10*d* and 10*g* on the skin around the ear touches a textured paving block in which the sound transmission devices 10*c*, 10*e*, and 10*f* are placed in advance, the person can listen to a caution sound.

In the sound transmission system 100 according to the first exemplary embodiment, as described in FIG. 2, the following case has been described where the sound signal generation device 120 and the sound transmission device 10 are connected to each other with the wire 13 having a cable. However, the sound transmission system is not limited to this case. For example, in another exemplary embodiment of the sound transmission system according to the present disclosure, the sound signal generation device 120 and the sound transmission device 10 may be partly connected wirelessly.

Also, in the sound transmission system 100 according to the first exemplary embodiment, as described in FIG. 2, the following case has been described where the sound signal generation device 120 and the sound transmission device 10 are configured as separate devices connected to each other with the wire 13 having a cable. However, the sound transmission system is not limited to this case. For example, the sound transmission system according to another exemplary embodiment of the present disclosure may be configured such that circuit components of the sound signal generation device 120 are formed on a conductor 12 side of the sound transmission device 10, and the sound transmission device 10 is an integrated device including the sound signal generation device 120.

Furthermore, in the sound transmission device 20 according to the second exemplary embodiment, as illustrated in FIG. 10(*b*), an example has been described in which the sound transmission device 20 is stuck using the adhesive layer 22 and worn on the skin around the ear. However, the sound transmission device is not limited to this example. For example, the sound transmission device 20 may be configured such that, only when listening to the sound from the sound signal generation device, the sound transmission device is pressed against the ear and worn on the skin around the ear. More specifically, the sound transmission device is used for a speaker of a smartphone or a cellular phone, and only during a call, a portion of the sound transmission device is pressed against the ear and worn on the skin around the ear. Also, the sound transmission device is used for a radio speaker, and only when listening to the radio, a portion of the sound transmission device is pressed against the ear and worn on the skin around the ear. Furthermore, the sound signal generation device and the sound transmission device may be provided in a frame portion of a pair of glasses, such that the sound transmission device 10 is worn on the skin around the ear only when a person wears the pair of glasses. It is noted that a battery is built in the sound signal generation device. Of course, power supply to the sound signal generation device is not limited to the built-in battery, and for example, power may be supplied from a battery for a power-assisted bicycle. In addition, it is possible to listen to a sound by providing the sound transmission device in a USB port of a personal computer and touching the sound transmission device by another person wearing another sound transmission device on the skin around the ear.

It should be considered that the exemplary embodiments disclosed this time are in all respects as illustrative and not restrictive. The scope of the present invention is indicated not by the above description but by the appended claims, and it is intended that all changes within the meaning and scope of the claims and equivalents are included.

DESCRIPTION OF REFERENCE SYMBOLS

10: Sound transmission device
11: Insulator
12: Conductor
13: Wire
14: Input portion
100: Sound transmission system
120: Sound signal generation device
130: Human body

The invention claimed is:

1. A sound transmission device comprising:

an insulator including a first portion configured to contact a human body;

a first conductor coupled to a second portion of the insulator different from the first portion;

an input disposed in the first conductor and configured to input a driving voltage based on a sound signal;

a second conductor configured to contact a different portion of the human body than a portion that contacts the first portion of the insulator; and a grounding insulator including a first main surface and a second main surface opposite the first main surface, wherein the first conductor includes a first main surface coupled to the second portion of the insulator, and a second main surface opposite the first main surface of the first conductor, wherein the first main surface of the grounding insulator is coupled to the second main surface of the first conductor, and wherein the second conductor is coupled to the second main surface of the grounding insulator.

2. The sound transmission device according to claim 1, wherein the second conductor is grounded.

3. The sound transmission device according to claim 1, wherein the insulator is a piezoelectric ceramic insulator.

4. The sound transmission device according to claim 1, wherein the second conductor is configured to contact a portion of the human body that is adjacent to the portion of the human body in contact with the first portion of the insulator.

5. The sound transmission device according to claim 1, wherein the first main surface of the grounding insulator has a diameter greater than a diameter of the first main surface of the first conductor.

6. The sound transmission device according to claim 1, further comprising a wire connected to the input, wherein the driving voltage based on the sound signal is input into the input through the wire.

7. A sound transmission system comprising:

a sound signal generation device; and a sound transmission device connected to the sound signal generation device and configured to contact a human body, the sound transmission device including:

an insulator including a first portion configured to contact the human body;

a first conductor coupled to a second portion of the insulator different from the first portion;

an input disposed in the first conductor and configured to input a driving voltage; and a second conductor configured to contact a different portion of the human body than a portion of the human body that is in contact with the first portion of the insulator, wherein a first end of the sound signal generation device is connected to the input of the sound transmission device and a second end of the sound signal generation device is configured to electrically connect to the human body, wherein the sound signal generation device supplies the driving voltage based on a sound signal to the sound transmission device via the input, and wherein the sound transmission device generates a sound only when the second end of the sound signal generation device and is electrically connected to the human body.

8. The sound transmission system according to claim 7, wherein the second conductor is grounded.

9. The sound transmission system according to claim 7, wherein the insulator is a piezoelectric ceramic insulator.

10. The sound transmission system according to claim 7, wherein the second conductor is configured to contact a portion of the human body that is adjacent to the portion of the human body in contact with the first portion of the insulator.

11. The sound transmission system according to claim 7, wherein the sound transmission device further includes a grounding insulator including a first main surface and a second main surface opposite the first main surface, wherein the first conductor includes a first main surface coupled to the second portion of the insulator, and a second main surface opposite the third main surface of the first conductor, wherein the first main surface of the grounding insulator is coupled to the second main surface of the first conductor, and wherein the second conductor is coupled to the second main surface of the grounding insulator.

12. The sound transmission system according to claim 11, wherein the first main surface of the grounding insulator has a diameter greater than a diameter of the first main surface of the first conductor.

13. The sound transmission system according to claim 7, wherein the first end of the sound signal generation device is connected to the input by a wire, and wherein the driving voltage based on the sound signal is input into the input through the wire.

14. The sound transmission system according to claim 7, further comprising a plurality of sound transmission devices including the sound transmission device, with the plurality of sound transmission devices connected in parallel to the sound signal generation device.

15. The sound transmission system according to claim 14, wherein the first end of the sound signal generation device is connected to the plurality of the sound transmission devices that are in contact with one of identical human bodies and different human bodies, and a second end of the sound signal generation device and the human bodies in contact with the plurality of sound transmission devices are grounded and electrically connected.

16. The sound transmission system according to claim 14, wherein one of the plurality of sound transmission devices is coupled to the first end of the sound signal generation device, and a second end of the sound signal generation device and another one of the plurality of sound transmission devices are grounded and electrically connected.

17. The sound transmission system according to claim 14, further comprising:

a pair of sound signal generation devices, including the sound signal generation device, wherein two of the plurality of sound transmission devices are connected to respective first ends of the pair of sound signal generation devices, and wherein respective second ends of the pair of sound signal generation devices and another of the plurality of sound transmission devices are grounded and electrically connected.

18. A sound transmission system comprising:

a sound signal generation device; and a sound transmission device connected to the sound signal generation device and configured to contact a human body, the sound transmission device including:

an insulator including a first portion configured to contact the human body;

a first conductor coupled to a second portion of the insulator different from the first portion;

an input disposed in the first conductor and configured to input a driving voltage; and a second conductor configured to contact a different portion of the human body than a portion of the human body that is in contact with the first portion of the insulator, wherein a first end of the sound signal generation device is connected to the input of the sound transmission device, and the sound signal generation device supplies the driving voltage based on a sound signal to the sound transmission device via the input, wherein the first end of the sound signal generation device is connected to the input by a wire and the driving voltage based on the sound signal is input into the input through the wire, and wherein a second end of the sound signal generation device and the human body in contact with the sound transmission device are grounded and electrically connected.

19. The sound transmission system according claim 18, wherein the sound transmission device generates a sound only when the second end of the sound signal generation device and is electrically connected to the human body.

* * * * *